US009864323B2

(12) United States Patent
Uohashi

(10) Patent No.: US 9,864,323 B2
(45) Date of Patent: Jan. 9, 2018

(54) OUTER COVER AND IMAGE FORMING APPARATUS COMPRISING THE SAME

(71) Applicant: KYOCERA Document Solutions Inc., Osaka (JP)

(72) Inventor: Yuki Uohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/234,407

(22) Filed: Aug. 11, 2016

(65) Prior Publication Data

US 2017/0060078 A1 Mar. 2, 2017

(30) Foreign Application Priority Data

Aug. 27, 2015 (JP) ..... 2015-167801

(51) Int. Cl.
*G03G 21/16* (2006.01)
*G03G 15/23* (2006.01)
*G03G 15/08* (2006.01)

(52) U.S. Cl.
CPC ..... *G03G 21/1633* (2013.01); *G03G 15/234* (2013.01); *G03G 21/1695* (2013.01); *G03G 15/0879* (2013.01); *G03G 2215/0132* (2013.01); *G03G 2221/169* (2013.01)

(58) Field of Classification Search
CPC ..... G03G 21/1633; G03G 21/1695; G03G 15/234; G03G 2215/0132; G03G 2221/169
See application file for complete search history.

(56) References Cited

U.S. PATENT DOCUMENTS 5,839,032 A * 11/1998 Yasui ..... G03G 15/231 271/184
5,991,570 A * 11/1999 Haga ..... G03G 21/1633 399/113
7,460,814 B2 * 12/2008 Ito ..... B41J 11/006 347/104
2008/0063430 A1 * 3/2008 Nobuoka ..... G03G 21/1633 399/124
2015/0084277 A1 * 3/2015 Maruyama ..... B65H 1/04 271/272
2017/0060068 A1 * 3/2017 Hori ..... G03G 15/234

FOREIGN PATENT DOCUMENTS

JP 2005-330067 A 12/2005

* cited by examiner

*Primary Examiner* — Rodney Bonnette
(74) *Attorney, Agent, or Firm* — Studebaker & Brackett PC

(57) ABSTRACT

An image forming apparatus includes an apparatus body, an outer cover, a conveyance unit, a movable roller, and an interlock mechanism. The outer cover is provided turnably between an outer closing position forming one surface of the apparatus body and an outer opening position in which the one surface of the apparatus body is set openable. The conveyance unit is provided turnably between an inner closing position in which an inside of the apparatus body is set closable and an inner opening position in which the inside of the apparatus body is set openable. The movable roller is pressed by a fixed roller pivotally supported inside of the apparatus body when the conveyance unit is displaced to the inner closing position. The interlock mechanism interlocks an operation of opening the outer cover with an operation of opening the conveyance unit.

3 Claims, 8 Drawing Sheets

OUTER COVER AND IMAGE FORMING APPARATUS COMPRISING THE SAME

INCORPORATION BY REFERENCE

This application is based on and claims the benefit of priority from Japanese Patent application No. 2015-167801 filed on Aug. 27, 2015, the entire contents of which are incorporated herein by reference.

BACKGROUND

The present disclosure relates to an image forming apparatus preferably applied in a copying machine or a printer or the like.

The image forming apparatus includes a conveyance path for conveying a sheet to an image forming part. Then, the image forming apparatus includes a mechanism for removing (unjamming) a sheet jammed within the conveyance path.

For instance, the image forming apparatus includes an opening/closing cover turnably supported on a side surface of an apparatus body of the image forming apparatus, a sheet conveyance guide member turnably supported within the apparatus body, a lock mechanism for locking the opening/closing cover and the sheet conveyance guide member to the apparatus body. The lock mechanism includes a first lock lever provided turnably to the opening/closing cover and a second lock lever provided turnably to the sheet conveyance guide member. The first lock lever is locked by a first locking member of the apparatus body. The second lock lever is locked by a second locking member of the apparatus body. The opening/closing cover is provided with an unlocking member integrally formed with the first lock lever on an outer surface thereof. When the unlocking member (the first lock lever) is turned in an unlocking direction, the second lock lever also turns in the unlocking direction through a moving member.

A secondary transfer roller is rotatably supported by the sheet conveyance guide member described above. The secondary transfer roller is in pressure contact with a driving roller around which a transfer belt is wrapped. Accordingly, the second lock lever has to be locked by the second locking member by a force exceeding a reaction force acting on the secondary transfer roller. However, if the second lock lever is strongly locked to the second locking member, a very large force is required to turn the unlocking member. Due to that, it is unable to readily open the opening/closing cover and the sheet conveyance guide member, causing such a problem that operability in performing an unjamming process drops.

Still further, the unlocking member, the two lock levers and the moving member are combined in a complex manner so that they interlock with each other in the lock mechanism described above. Due to that, it is difficult to reduce a manufacturing cost of the lock mechanism.

SUMMARY

According to one aspect of the present disclosure, an image forming apparatus includes an apparatus body, an outer cover, a conveyance unit, a movable roller, and an interlock mechanism. The outer cover is provided turnably between an outer closing position forming one surface of the apparatus body and an outer opening position in which the one surface of the apparatus body is set openable. The conveyance unit is disposed inside of the apparatus body more than the outer cover. The conveyance unit is provided turnably between an inner closing position in which an inside of the apparatus body is set closable and an inner opening position in which the inside of the apparatus body is set openable. The movable roller is pivotally supported by the conveyance unit and is pressed by a fixed roller pivotally supported inside of the apparatus body when the conveyance unit is displaced to the inner closing position. The interlock mechanism interlocks an operation of opening the outer cover with an operation of opening the conveyance unit.

The interlock mechanism includes an inner engaging part and an outer engaging part. The inner engaging part is provided in the conveyance unit. The inner engaging part is configured to be turnable between a lock position in which the inner engaging part is locked by an engaged part provided within the apparatus body and an unlock position in which the inner engaging part is unlocked from the engaged part. The outer engaging part is fixed to the outer cover. The outer engaging part is configured to engage with the inner engaging part locked by the engaged part when the outer cover is displaced to the outer closing position.

The inner engaging part holds the conveyance unit at the inner closing position by resisting against a reaction force received by the movable roller by locking with the engaged part.

The outer engaging part turns the inner engaging part from the lock position to the unlock position by relatively sliding with the inner engaging part in a process of turning the outer cover from the outer closing position to the outer opening position.

The outer engaging part is disengaged relatively from the inner engaging part after turning the conveyance unit from the inner closing position to the inner opening position by relatively sliding with the inner engaging part in a case of turning the outer cover further to the outer opening position after when the inner engaging part is displaced to the unlock position.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

A preferred embodiment of the present disclosure will be described below with reference to the appended drawings. It is noted that the following description will be made by defining a front side of sheet surfaces of FIGS. 1, 4 through 8, and based on directions indicated in each drawing. Still further, 'upstream', 'downstream' and similar terms thereof indicate 'upstream', 'downstream', and concepts similar to them in the conveyance direction.

Figure 1:
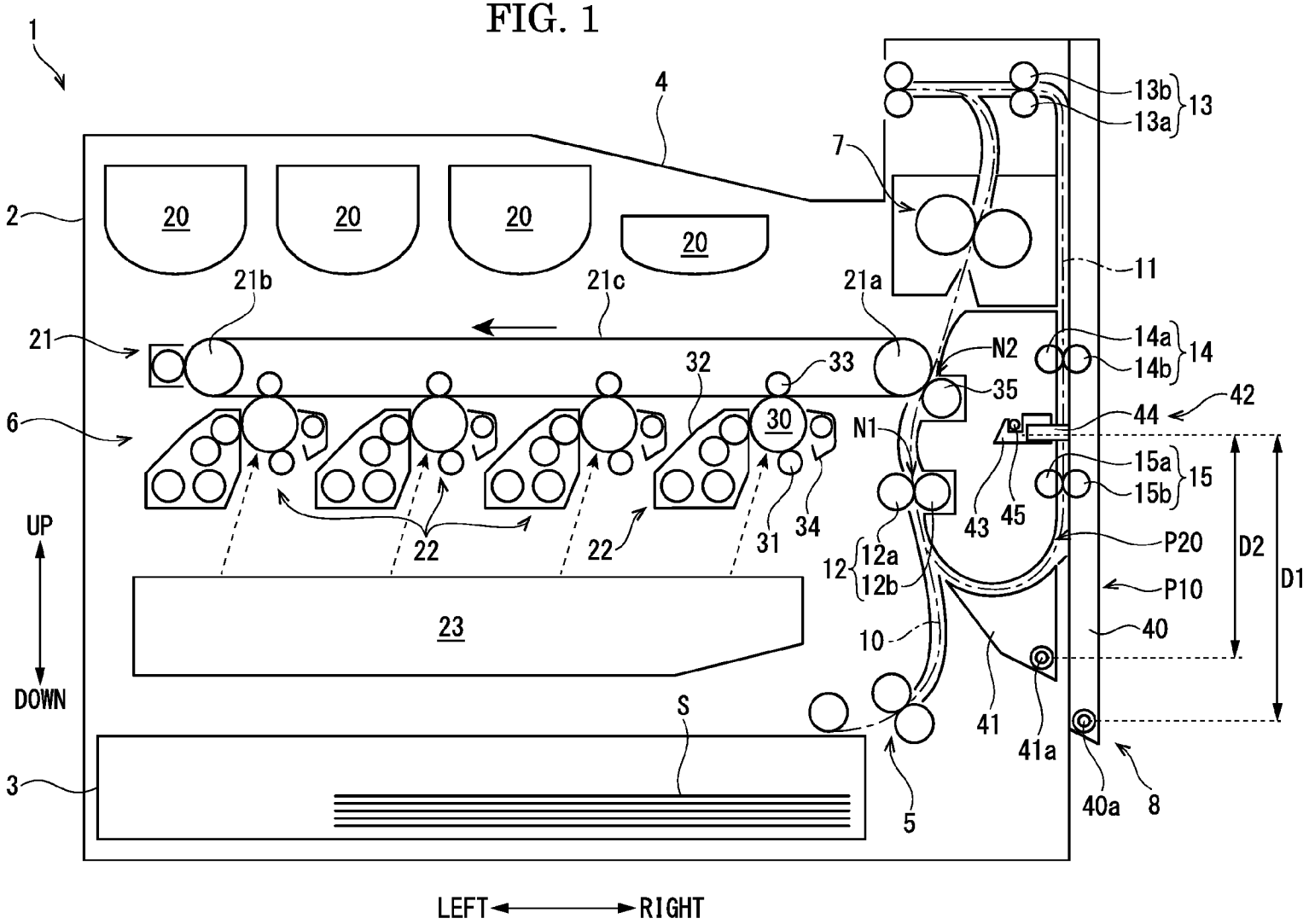
FIG. 1 is a sectional view schematically showing an inner structure of a color printer according to one embodiment of the present disclosure.

With reference to FIG. 1, a color printer 1 as an image forming apparatus will be described. FIG. 1 is a sectional view schematically showing an inner structure of the color printer 1.

The color printer 1 includes a box-like apparatus body 2. The sheet feed cassette 3 is provided in a lower part of the apparatus body 2. The sheet S (bundle of the sheets S) is stored within the sheet feed cassette 3. The sheet discharge tray 4 is provided in a upper part of the apparatus body 2. It is noted that the sheet S is not limited to a sheet of paper and may be a resin film or the like.

The color printer 1 includes a sheet feeding part 5, an image forming part 6 and a fixing unit 7 within the apparatus body 2. The sheet feeding part 5 is provided upstream of a main conveyance path 10 extended from the sheet feed cassette 3 to the discharge tray 4. The image forming part 6 is provided at an intermediate part of the main conveyance path 10. The fixing unit 7 is provided downstream of the main conveyance path 10.

The main conveyance path 10 extends in a vertical direction on a right side of the apparatus body 2. An inverse conveyance path 11 conveying the sheet S in printing on both surfaces is disposed on a right side (outer side) of the main conveyance path 10. The inverse conveyance path 11 branches downstream of the main conveyance path 10, extends downward, and merges with an upstream side of the main conveyance path 10.

A registration roller pair 12 is provided along the main conveyance path 10. The registration roller pair 12 includes a driven roller 12*b* in pressure-contact with the driving roller 12*a*. A registration nip part N1 is formed between the driving and driven rollers 12*a* and 12*b*. The registration roller pair 12 temporarily blocks the sheet S being conveyed through the main conveyance path 10 and corrects an inclination of the sheet S (so-called skew correcting).

A plurality (three for example) of conveyance roller pairs 13, 14 and 15 is provided along the inverse conveyance path 11. The respective roller pairs 13, 14 and 15 includes driven rollers 13*b*, 14*b* and 15*b* respectively in pressure contact with the driving rollers 13*a*, 14*a* and 15*a*.

It is noted that the respective driving rollers 12*a* through 15*a* are connected with a power transmission mechanism not shown and including a driving motor and others. The respective driven rollers 12*b* through 15*b* rotate following the respective driving rollers 12*a* through 15*a* rotationally driven by the driving motor. The registration roller pair 12 and the respective conveyance roller pair 13, 14 and 15 nip the sheet S and rotate to feed the sheet S to downstream.

The image forming part 6 includes four tonner containers 20, an intermediate transfer unit 21, four drum units 22 and an optical scanning device 23. The four tonner containers 25 house toners (developing agents) of four colors. The intermediate transfer unit 21 is disposed under the four tonner containers 25. The four drum units 22 are arrayed in parallel in the left-right direction under the intermediate transfer unit 21. The optical scanning device 23 is disposed under the respective drum units 22.

The intermediate transfer unit 21 includes a transfer driving roller 21*a*, a transfer driven roller 21*b* and an intermediate transfer belt 21*c*. The transfer driving roller 21*a* and the transfer driven roller 21*b* are supported around shafts respectively within the apparatus body 2. The transfer driving roller 21*a* is disposed on the side of the main conveyance path 10 and is connected with a power transmission mechanism. The transfer driven roller 21*b* is disposed on a left side of the apparatus body 2. The intermediate transfer belt 21*c* is formed endlessly and is suspended between the transfer driving roller 21*a* and the transfer driven roller 21*b*. When the transfer driving roller 21*a* is rotated, the intermediate transfer belt 21*c* circularly travels in a direction of an arrow in FIG. 1.

Each of the drum units 22 includes a photosensitive drum 30, a charging device 31, a developing device 32, a primary transferring roller 33 and a cleaning device 34. Each drum unit 22 transfers the toner image on the photosensitive drum 30 to the intermediate transfer belt 21*c*. A secondary transfer roller 35 forming a secondary transfer nip part N2 is disposed on a right side of the intermediate transfer belt 21*c*. The full-color toner image borne on the intermediate transfer belt 21*c* is transferred onto the sheet S passing through the secondary transfer nip part N2. The fixing unit 13 fixes the toner image on the sheet S. The sheet S which has been fixed is discharged on the discharge tray 4.

In a case of printing on both surfaces of the sheet S, the sheet S which has passed through the fixing unit 7 is switched back at a downstream end of the main conveyance path 10 and is sent to the inverse conveyance path 11. Then, the sheet S enters again to the main conveyance path 10 from the inverse conveyance path 11 and is conveyed again toward the image forming part 6 (the secondary transfer nip part N2). This arrangement makes it possible to form images on the both surfaces of the sheet S.

By the way, the color printer 1 as described above is configured to detect a conveyance failure (jamming) of the sheet S by using detectors not shown and disposed along the main conveyance path 10 and the inverse conveyance path 11. For example, the detector transmits a signal indicating an occurrence of jamming to a controller. Recognizing the occurrence of the jamming, the controller halts the image forming operation and displays a message or the like indicating that the jamming has occurred on a liquid crystal display (LCD) or the like not shown of the color printer 1. Then, a user executes an unjamming process in accordance to messages displayed on the LCD. The color printer 1 of the present embodiment includes an unjamming structure 8 to remove the sheet S jammed within the main conveyance path 10 or the inverse conveyance path 11.

Figure 2:
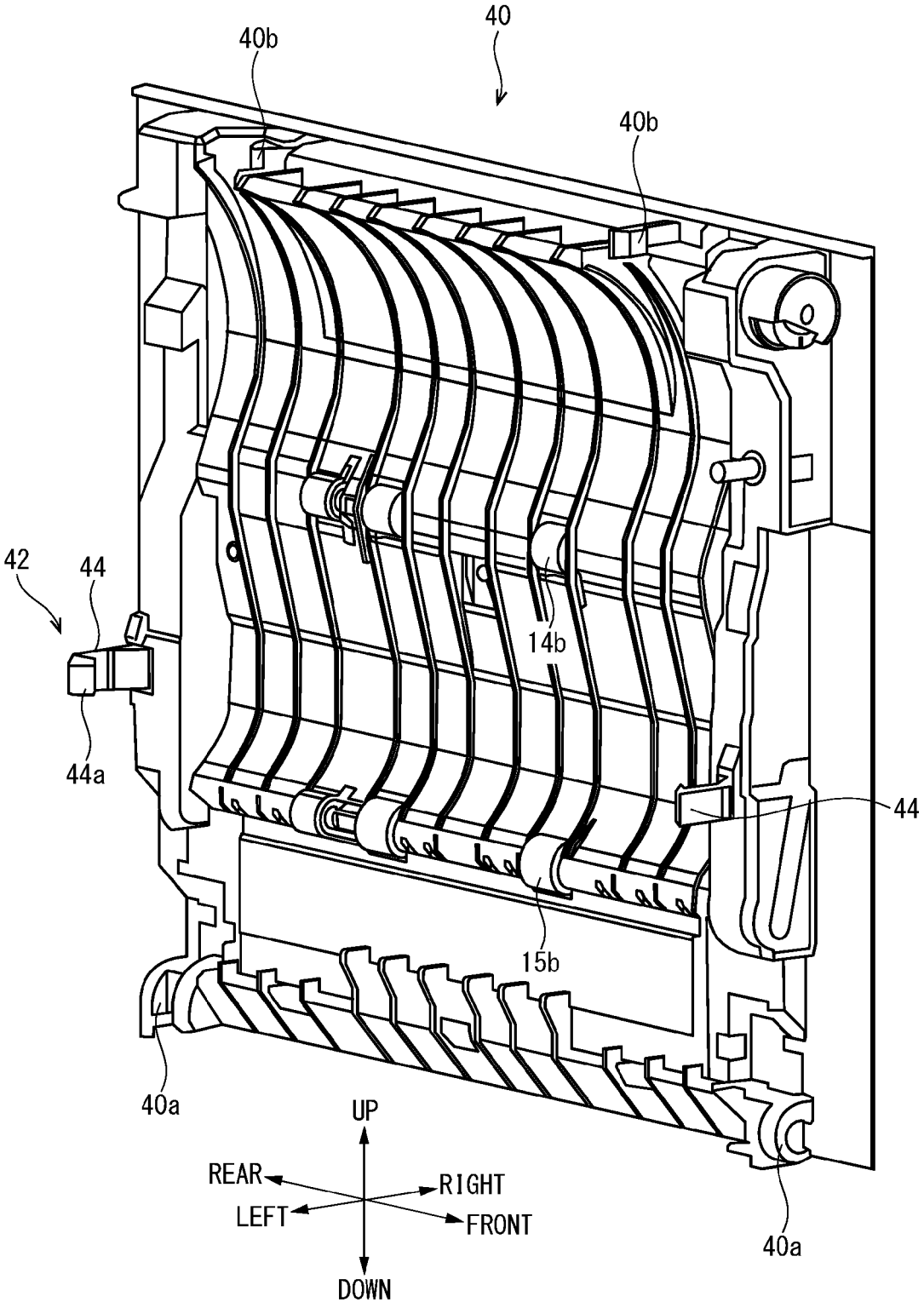
FIG. 2 is a perspective view illustrating an outer cover of the color printer of one embodiment of the present disclosure.
Figure 3:
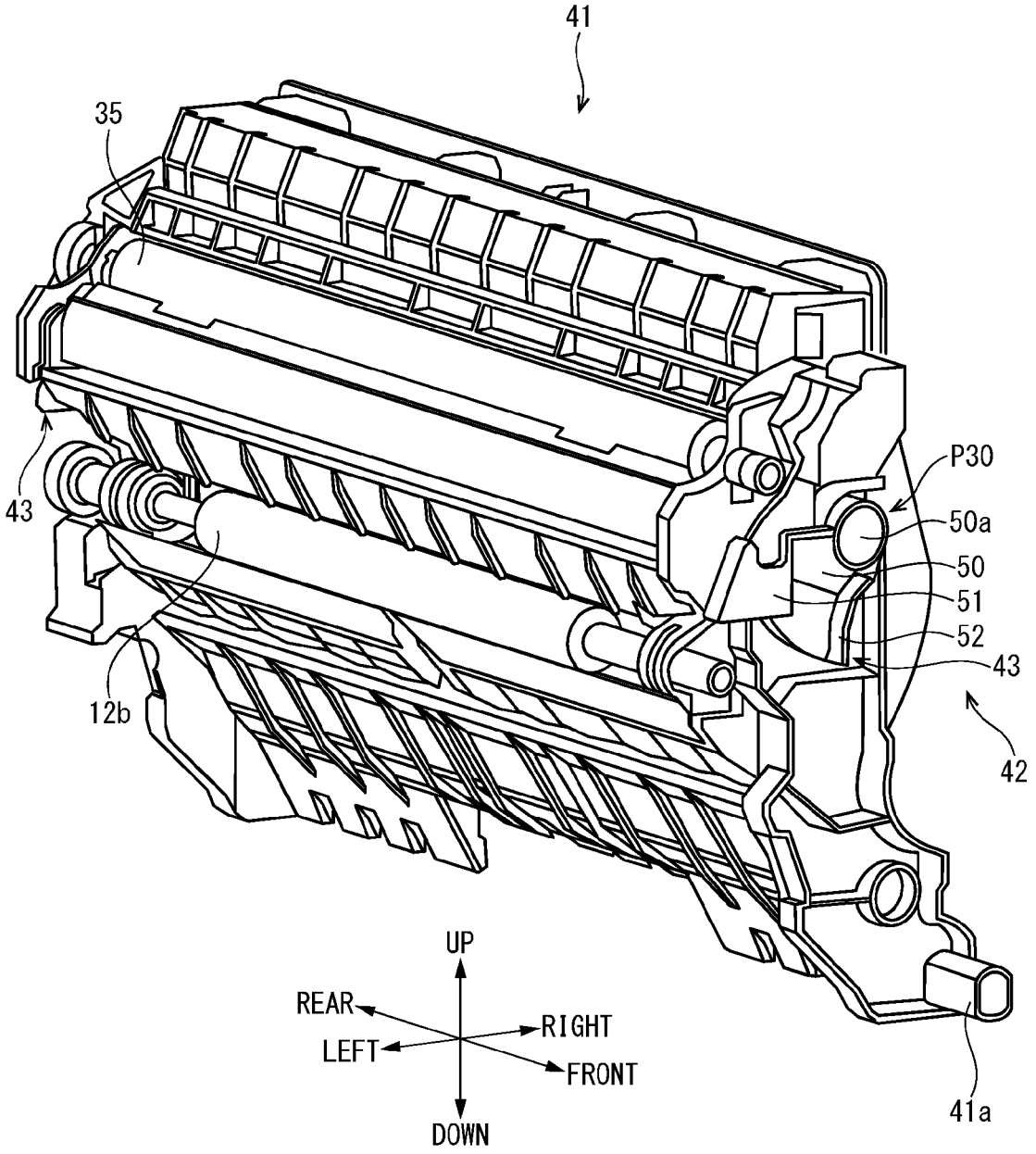
FIG. 3 is a perspective view illustrating a conveyance unit of the color printer of one embodiment of the present disclosure.
Figure 4:
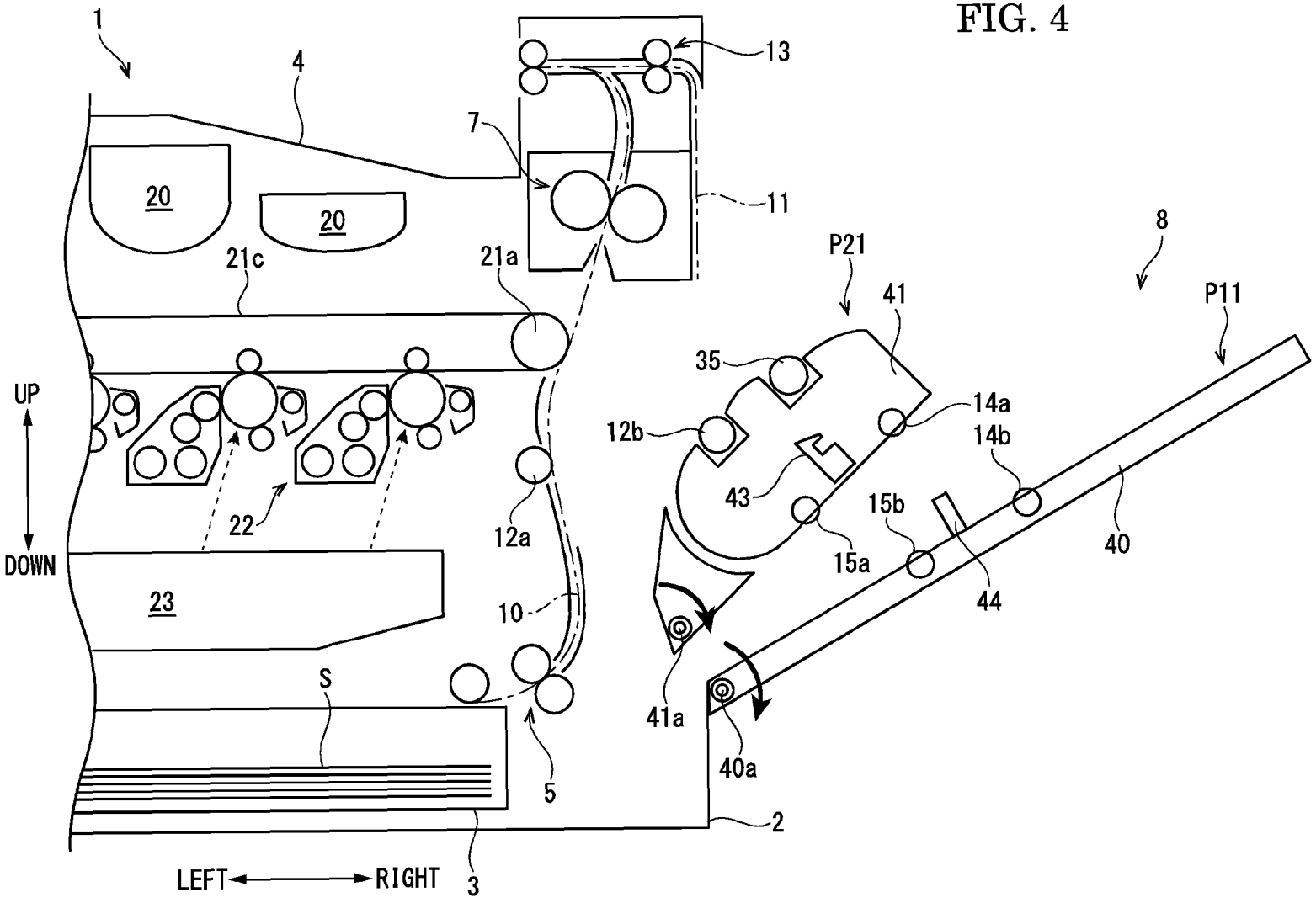
FIG. 4 is a section view schematically illustrating an unjamming structure in which each cover is opened in the color printer according to one embodiment of the present disclosure.
Figure 5:
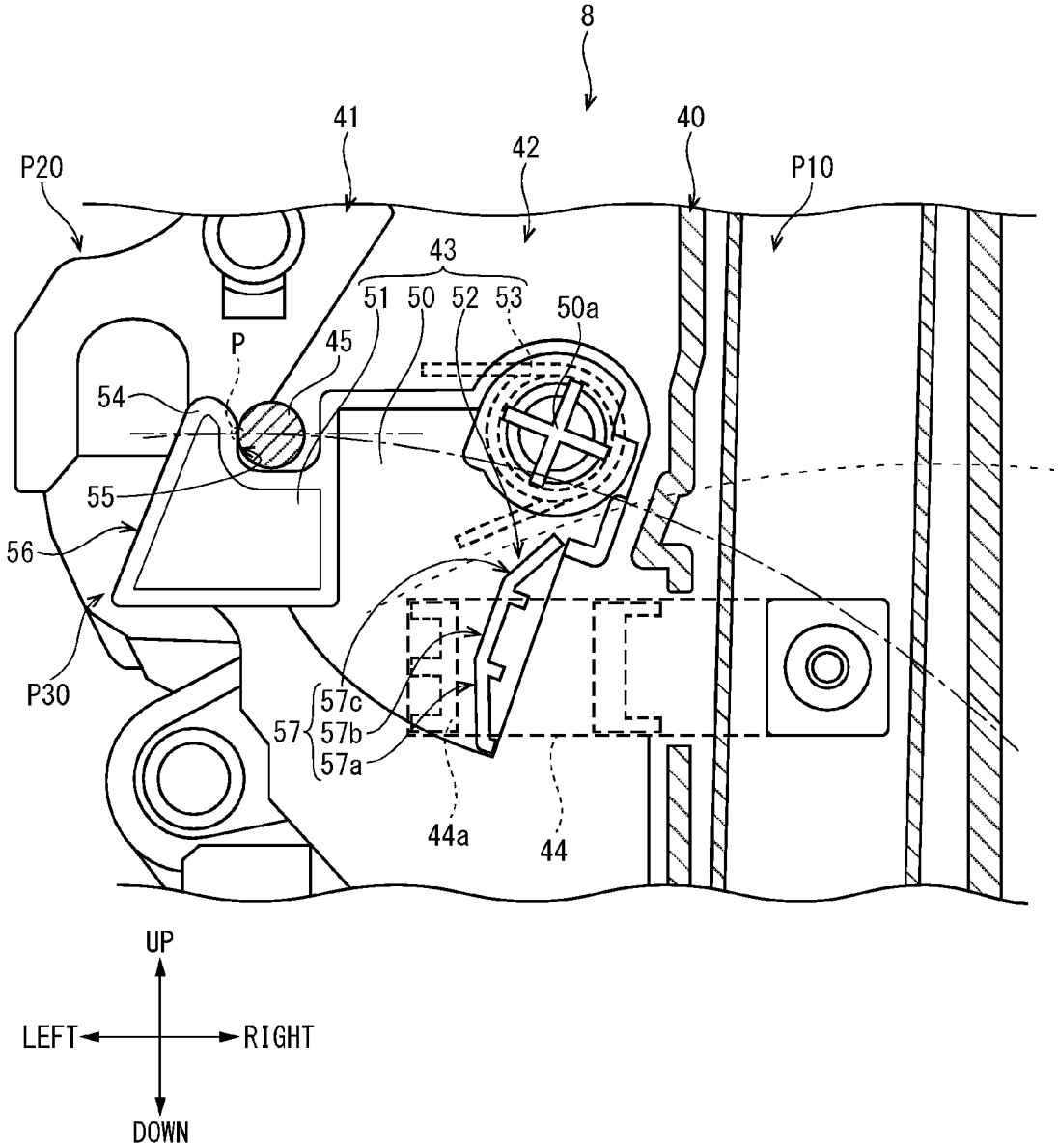
FIG. 5 is a front view illustrating an inner hook and others displaced to a lock position in an interlock mechanism of the color printer according to one embodiment of the present disclosure.
Figure 6:
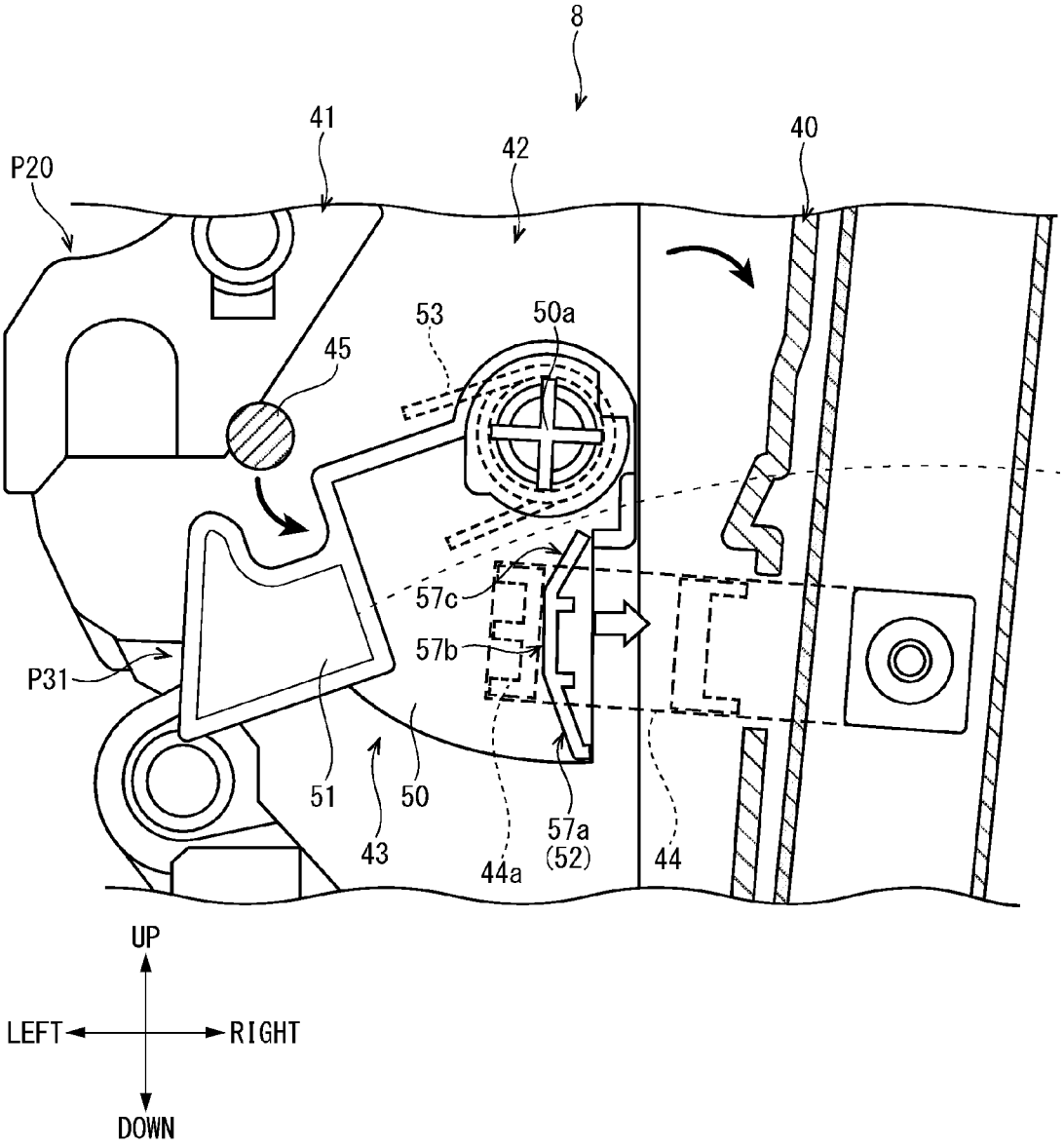
FIG. 6 is a front view illustrating an inner hook and others displaced to a unlock position in an interlock mechanism of the color printer according to one embodiment of the present disclosure.

Next, reference to FIGS. 1 through 6, the unjamming structure 8 will be described. FIG. 2 is a perspective view illustrating an outer cover 40. FIG. 3 is a perspective view illustrating a conveyance unit 41. FIG. 4 is a section view schematically illustrating an unjamming structure 8 in which each cover 40, 41 is opened. FIG. 5 is a front view illustrating an inner hook 43 and others displaced to a lock position P30 in an interlock mechanism 42. FIG. 6 is a front view illustrating an inner hook 43 and others displaced to a unlock position P31 in an interlock mechanism 42.

As shown in FIGS. 1 through 3, the unjamming structure 8 includes the outer cover 40, the conveyance unit 41 and the interlock mechanism 42. The outer cover 40 is provided openably/closably on the right side surface of the apparatus body 2. The conveyance unit 41 is provided openably/closably within the apparatus body 2. The interlock mechanism 42 is configured so as to interlock an opening operation of the outer cover 40 with an opening operation of the conveyance unit 41.

As shown in FIG. 2, the outer cover 40 is formed approximately into a shape of a rectangular plate by a synthetic resin material for example. The outer cover 40 is provided with a pair of front and rear outer turning shafts 40*a* at a lower end part thereof. The outer cover 40 is provided turnably centering on respective outer turning shafts 40*a*. More specifically, the outer cover 40 is provided turnably between an outer closing position P10 (see FIG. 1) forming one surface (right side surface) of the apparatus body 2 and an outer opening position P11 in which the right side surface of the apparatus body 2 is set to be openable (see FIG. 4).

When the outer cover 40 is displaced to the outer closing position P10, an outer surface (right surface) of the outer cover 40 forms the right surface of the apparatus body 2 and an inner surface (left surface) of the outer cover 40 forms one side (right surface) of the inverse conveyance path 11 (see FIG. 1). When the outer cover 40 is displaced to the outer opening position P11, the inverse conveyance path 11 is opened (the conveyance unit 41 is exposed) (see FIG. 4). This arrangement makes it possible to remove the sheet S jammed in the inverse conveyance path 11.

As shown in FIGS. 1 and 2, driven rollers 14*b* and 15*b* of the respective conveyance roller pairs 14 and 15 are pivotally supported on an inner surface of the outer cover 40. As shown in FIG. 2, the outer cover 40 is provided with a pair of front and rear fixed hooks 40*b* projecting toward the inside (left side in FIG. 2) of the apparatus body 2 at an upper part thereof. While not shown, a pair of front and rear hook engaging parts is formed at an upper end part of the apparatus body 2. The outer cover 40 is held at the outer closing position P10 by hooking the respective fixed hooks 40*b* to the respective hook engaging parts. It is noted that the outer cover 40 is provided, on an outer surface thereof, with an operation lever (not shown) for unhooking the respective fixed hooks 40*b* from the respective hook engaging parts.

As shown in FIG. 3, the conveyance unit 41 is formed mainly of a synthetic resin material for example approximately into a rectangular parallelepiped shape. As shown in FIG. 1, the conveyance unit 41 is disposed inside of the apparatus body 2 more than the outer cover 40. The conveyance unit 41 is provided with a pair of front and rear inner turning shafts 41*a* at a lower end part thereof. The conveyance unit 41 is turnable centering on the respective inner turning shaft 41*a*. More specifically, the conveyance unit 41 is turnable between an inner closing position P20 (see FIG. 1) in which the inside of the apparatus body 2 is set closable and an inner opening position P21 (see FIG. 4) in which the inside of the apparatus body 2 is set openable.

As shown in FIG. 1, the inner turning shaft 41*a* is provided above the outer turning shaft 40*a*. In a state in which the conveyance unit 41 is displaced at the inner closing position P20, the conveyance unit 41 is disposed at a vertically intermediate part of the outer cover 40 displaced at the outer closing position P10.

When the conveyance unit 41 is displaced at the inner closing position P20, an inner surface (left surface) of the conveyance unit 41 forms one side (right surface) of the main conveyance path 10 and an outer surface (right surface) of the outer cover 40 forms another surface (left surface) of the inverse conveyance path 11 (see FIG. 1). When the conveyance unit 41 is displaced at the inner opening position P21, the main conveyance path 10 is opened (see FIG. 4). Thereby, it is possible to remove the sheet S jammed within the main conveyance path 10.

As shown in FIGS. 1 and 3, the conveyance unit 41 is provided with a driven roller 12*b* of the registration roller pair 12 and a secondary transfer roller 35 pivotally supported on the inner surface thereof. Driving rollers 14*a* and 15*a* of the conveyance roller pairs 14 and 15 are pivotally supported respectively on the outer surface of the conveyance unit 41 (see FIG. 1).

When the conveyance unit 41 is displaced at the inner closing position P20 as shown in FIG. 1, the driven roller 12*b* is pressed by the driving roller 12*a* pivotally supported inside of the apparatus body 2. Similarly to that, the secondary transfer roller 35 is pressed by the transfer driving roller 21*a* across the intermediate transfer belt 21*c*. It is noted that the driven roller 12*b* and the secondary transfer roller 35 are specific examples of 'movable rollers' referred in claims of the present disclosure. Still further, the driving roller 12*a* and the transfer driving roller 21*a* are specific examples of 'fixed rollers' referred in claims.

When the conveyance unit 41 is displaced at the inner closing position P20 and the outer cover 40 is displaced at the inner closing position P20, the respective driven rollers 14*b* and 15*b* are pressed by the respective driving rollers 14*a* and 15*a* pivotally supported by the conveyance unit 41. It is noted that a pressing force acting between the respective conveyance roller pairs 14 and 15 is set to be weaker (smaller) than a pressing force acting on the respective nip parts N1 and N2.

As shown in FIGS. 2 and 3, the interlock mechanism 42 includes a pair of front and rear inner hooks 43 and a pair of front and rear outer hooks 44. The pair of front and rear inner hooks 43, i.e., exemplary inner engaging parts, is provided at both front and rear end surfaces of the conveyance unit 41 (see FIG. 3). The pair of front and rear outer hooks 44, i.e., exemplary outer engaging parts, is fixed at both front and rear sides of the outer cover 40 (see FIG. 2). It is noted that because the two inner hooks 43 have almost identical structure, one inner hook 43 will be described below. By the same reason, one outer hook 44 will be described. It is noted that the following description will be made based on the state in which the outer cover 40 is displaced at the outer closing position P10 and the conveyance unit 41 is displaced at the inner closing position P20.

As shown in FIG. 3, the inner hook 43 is disposed above a vertical center of the conveyance unit 41 in a front view. As shown in FIG. 5, the inner hook 43 is formed so as to be hooked by an engagement boss 45, i.e., an exemplary engaged part, provided within the apparatus body 2. More specifically, the inner hook 43 is configured to be turnable between a lock position P30 (see FIG. 5) in which the inner hook 43 is set to be locked by the engagement boss 45 and a unlock position P31 (see FIG. 6) in which the inner hook 43 is set to be unlocked from the engagement boss 45. The inner hook 43 holds the conveyance unit 41 at the inner closing position P20 by resisting against a reaction force received by the driven roller 12*b* and the secondary transfer roller 35 from the driving roller 12*a* and the transfer driving roller 21*a* by engaging with the engagement boss 45 (see FIG. 1).

Meanwhile, as shown in FIG. 2, the outer hook 44 is disposed below the vertical center of the outer cover 40 in a front view. The outer hook 44 is formed approximately into a rectangular plate in a front view and extends from the inner surface of the outer cover 40 to the inside of the apparatus body 2. The outer hook 44 is formed to be elastically deformable in the front-rear direction at a fulcrum of a base end part thereof. The outer hook 44 is provided, at an extended tip thereof, with a hook-like claw 44*a*. When the outer cover 40 is displaced to the outer closing position P10, the outer hook 44 engages with the inner hook 43 locked by the engagement boss 45 (see FIG. 5). It is noted that an inner surface of the claw 44*a* is inclined outside toward the tip.

Here, the inner hook 43 will be described in detail. As shown in FIG. 5, the inner hook 43 includes an engaging body 50, a hook part 51, an interlock part 52 and a torsion coil spring 53. The engaging body 50, the hook part 51 and the interlock part 52 are integrally formed of a synthetic resin material for example.

The engaging body 50 is turnable centering on an engagement turning shaft 50*a*. The engagement turning shaft 50*a* is disposed at an upper right part of the engaging body 50.

The hook part 51 is continuously provided on a left side of the engaging body 50 and is formed so as to be hooked by the engagement boss 45. The hook part 51 includes a bent part 54 bent upward at a tip of the hook part 51 extending in the left direction from the engaging body 50. The hook part 51, i.e., the bent part 54, is configured to be hooked to the engagement boss 45 from underneath. The hook part 51, i.e., the bent part 54, includes an abutment surface 55 orthogonal to a tangential direction (see a two-dot chain line in FIG. 5) of a turning locus (see a one-dot chain line in FIG. 5) of the conveyance unit 41 passing through a contact point P of the engagement boss 45. The abutment surface 55 of the present embodiment is formed to be approximately vertical in a front view. The hook part 51 also includes an inclined surface 56 formed at the tip (left end part) of the hook part 51 so as to rise from the left side toward the right side.

The interlock part 52 projects from the engaging body 50 toward outside in the front-rear direction. The interlock part 52 is provided under the engagement turning shaft 50*a*. The interlock part 52 is formed so as to be able to come into sliding-contact with the claw 44*a* of the outer hook 44. The interlock part 52 includes a sliding-contact surface 57 bent so as to run along a turning locus (see a broken line in FIG. 5) of the claw 44*a* of the outer hook 44 turning integrally with the outer cover 40. More specifically, the sliding-contact surface 57 includes an intermediate sliding contact surface 57*b* between lower and upper sliding contact surfaces 57*a* and 57*c* and is formed approximately into a trapezoidal shape tapered toward the left side in a front view. It is noted that the claw 44*a* of the outer hook 44 faces contactlessly to the lower sliding contact surface 57*a* of the interlock part 52 of the inner hook 43 displaced to the lock position P30.

The torsion coil spring 53, i.e., an exemplary urging member, is provided around the engagement turning shaft 50*a* and urges the engaging body 50 toward the lock position P30.

Figure 7:
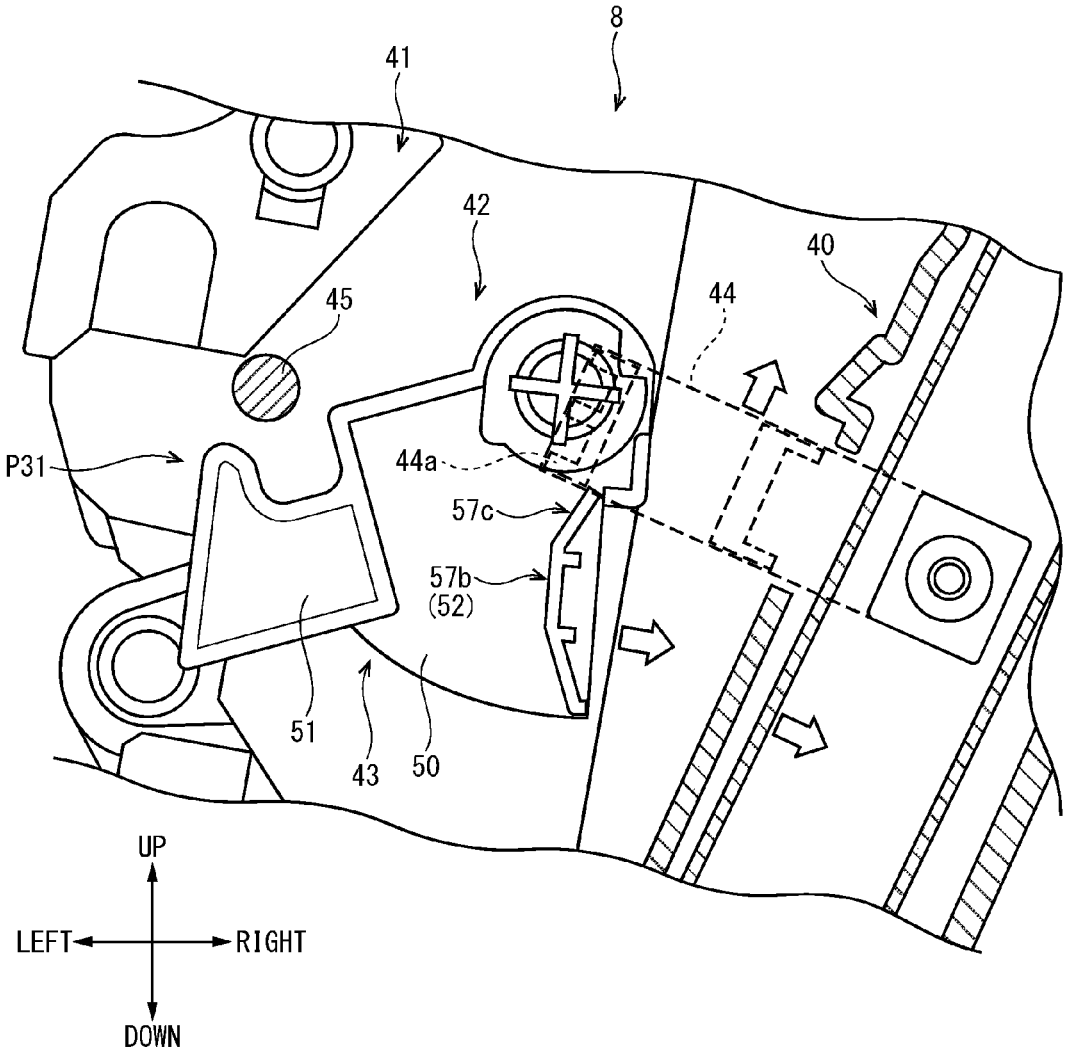
FIG. 7 is a front view illustrating a process in which an outer lock separating from an inner hook in the interlock mechanism of the color printer according to one embodiment of the present disclosure.

Next, an unjamming operation, i.e., an operation of the unjamming structure 8, will be described with reference to FIGS. 4 through 7. FIG. 7 is a front view illustrating a process in which the outer hook 44 is disengaged from the inner hook 43.

As described above, if a failure of conveyance of the sheet S occurs in the main conveyance path 10 or the inverse conveyance path 11, a control unit indicates a message on a liquid crystal screen or the like. A user operates the operation lever of the outer cover 40 to disengage the respective fixed hooks 40*b* from the respective hook engaging parts. Then, the user turns the outer cover 40 in an opening direction (in the right direction) by pulling the operation lever to the outside (the right side) (see FIG. 4).

In a process in which the outer cover 40 turns from the outer closing position P10 to the outer opening position P11, the outer hook 44 turns the inner hook 43 from the lock position P30 to the unlock position P31 by relatively sliding against the inner hook 43. More specifically, in response to the turn of the outer cover 40 in the opening direction (the right direction), the claw 44*a* of the outer hook 44 abuts against the lower sliding contact surface 57*a* of the inner hook 43 (see FIG. 5) and pulls the inner hook 43 in the right direction.

Then, as shown in FIG. 6, the inner hook 43 turns downward centering on the engagement turning shaft 50*a* while resisting against the urging force of the torsion coil spring 53, and the claw 44*a* of the outer hook 44 turns relatively upward. When the inner hook 43 turns from the lock position P30 to the unlock position P31, the claw 44*a* of the outer hook 44 slides relatively from the lower sliding contact surface 57*a* to the intermediate sliding contact surface 57*b*.

In a case when the outer cover 40 is turned further toward the outer opening position P11 after when the inner hook 43 has been displaced to the unlock position P31, the outer hook 44 turns the conveyance unit 41 from the inner closing position P20 to the inner opening position P21 while sliding relatively with the inner hook 43. More specifically, as shown in FIG. 7, when the outer cover 40 is turned further in the opening direction, the claw 44*a* of the outer hook 44 pulls the inner hook 43 toward the inner opening position P21 while sliding from the intermediate sliding contact surface 57*b* to the upper sliding contact surface 57*c* of the inner hook 43. It is noted that the conveyance unit 41 is pushed outside (the right side) by the reaction force received by the driven roller 12*b* (the secondary transfer roller 35) from the driving roller 12*a* (the transfer driving roller 21*a*).

As the opening (turning) move of the conveyance unit 41 advances further, the outer hook 44 is disengaged relatively from the inner hook 43 (the interlock part 52) (see FIG. 7). The outer turning shaft 40*a* of the outer hook 44 is disposed under the inner turning shaft 41*a* of the conveyance unit 41 as described above. A distance D1 from the outer turning shaft 40*a* to the outer hook 44 is longer than a distance D2 from the inner turning shaft 41*a* to the inner hook 43 (D1 >D2) (see FIG. 1). Therefore, because a turning radius of the outer hook 44 is larger than a turning radius of the inner hook 43, the outer hook 44 separates upward from the inner hook 43 in the process of opening the outer cover 40. That is, the claw 44*a* of the outer hook 44 slips through upward from the upper sliding contact surface 57*c* (see FIG. 7). It is noted that if the outer hook 44 is disengaged from the inner hook 43, the inner hook 43 is urged by the torsion coil spring 53 and returns to the lock position P30 (see FIG. 5).

The conveyance unit 41 and the outer cover 40 are opened and the main conveyance path 10 and the inverse conveyance path 11 are exposed by the process described above (see FIG. 4). Then, the user removes (unjams) the sheet S jammed within the main conveyance path 10 or the inverse conveyance path 11.

After finishing the unjamming process, the user returns the conveyance unit 41 from the inner opening position P21 to the inner closing position P20. While not shown, the engagement boss 45 relatively slides on the inclined surface 56 of the inner hook 43 and turns the inner hook 43 downward in the process of turning the conveyance unit 41 from the inner opening position P21 to the inner closing position P20. When the relatively moving engage boss 45 rides over the bent part 54 of the inner hook 43, the inner hook 43 returns to the lock position P30 by being urged by the torsion coil spring 53 and is locked by the engagement boss 45 (see FIG. 5). The abutment surface 55 of the inner hook 43 comes into pressure-contact with the engagement boss 45 by the reaction force acting on the driven roller 12*b* and the secondary transfer roller 35. Because the abutment surface 55 of the hook part 51 is formed such that it is hardly unlocked from the engagement boss 45, the conveyance unit 41 can be adequately held at the inner closing position P20.

Next, the user returns the outer cover 40 from the outer opening position P11 to the outer closing position P10. In the process of turning the outer cover 40 from the outer opening position P11 to the outer closing position P10, the inner surface (inclined surface) of the claw 44*a* slides with the outer end surface of the interlock part 52 and the outer hook 44 elastically deforms to outside. Then, the claw 44*a* is displaced to the inside by a restoring force of the outer hook 44 and engages with the sliding-contact surface 57 by riding over the interlock part 52. Thereby, the conveyance unit 41 and the outer cover 40 are closed approximately in the same time.

It is noted that it is also possible to arrange such that the conveyance unit 41 and the outer cover 40 close approximately in the same time from the state in which they are opened. For instance, if the user turns the outer cover 40 in the closing direction, the conveyance unit 41 returns to the inner closing position P20 by being pressed by the outer cover 40 moving toward the outer closing position P10. In the process in which the outer cover 40 turns from the outer opening position P11 to the outer closing position P10, the outer hook 44 (the claw 44*a*) engages with the interlock part 52 (the sliding-contact surface 57) of the inner hook 43 from the upper right direction. The sliding-contact surface 57 of the interlock part 52 is formed along the turning locus of the claw 44*a* (see FIG. 5). Therefore, it is possible to prevent an interference of the claw 44*a* with the interlock part 52 when the outer cover 40 is returned from the outer opening position P11 to the outer closing position P10. This arrangement makes it possible to smoothly close the outer cover 40. It is noted that the respective hooks 40*b* of the outer cover 40 engage with the respective hook engaging parts.

According to the color printer 1 of the embodiment described above, the conveyance unit 41 is held at the inner closing position P20 by the inner hook 43, so that it is possible to prevent the reaction force acting on the driven roller 12*b* and the secondary transfer roller 35 from affecting the outer cover 40. Meanwhile, the outer hook 44 engages with the inner hook 43 and turns in a body with the outer cover 40 turning in the opening direction. The user can turn (unlock) the inner hook 43 and open the conveyance unit 41 just by opening the outer cover 40. This arrangement makes it possible to readily open the outer cover 40 and the conveyance unit 41 with one operation. Due to that, operability of the unjamming process can be improved. Still further, because only the inner hook 43 is configured to be turnable and the outer hook 44 needs not be turned, it is possible to simplify the configuration of the interlock mechanism 42 and to cut a manufacturing cost of the interlock mechanism 42.

Still further, according to the color printer 1 of the present embodiment, the outer hook 44 is separated from the inner hook 43 in the state in which the outer cover 40 is displaced at the outer opening position P11. In closing the outer cover 40 and the conveyance unit 41, the outer cover 40 is closed after closing the conveyance unit 41 by resisting against the reaction force acting on the driven roller 12*b* and the secondary transfer roller 35. Therefore, the closing operation of the outer cover 40 is not hampered by the reaction force acting on the driven roller 12*b* and others. This arrangement makes it possible to close only the outer cover 40 with a small force (low load).

Figure 8:
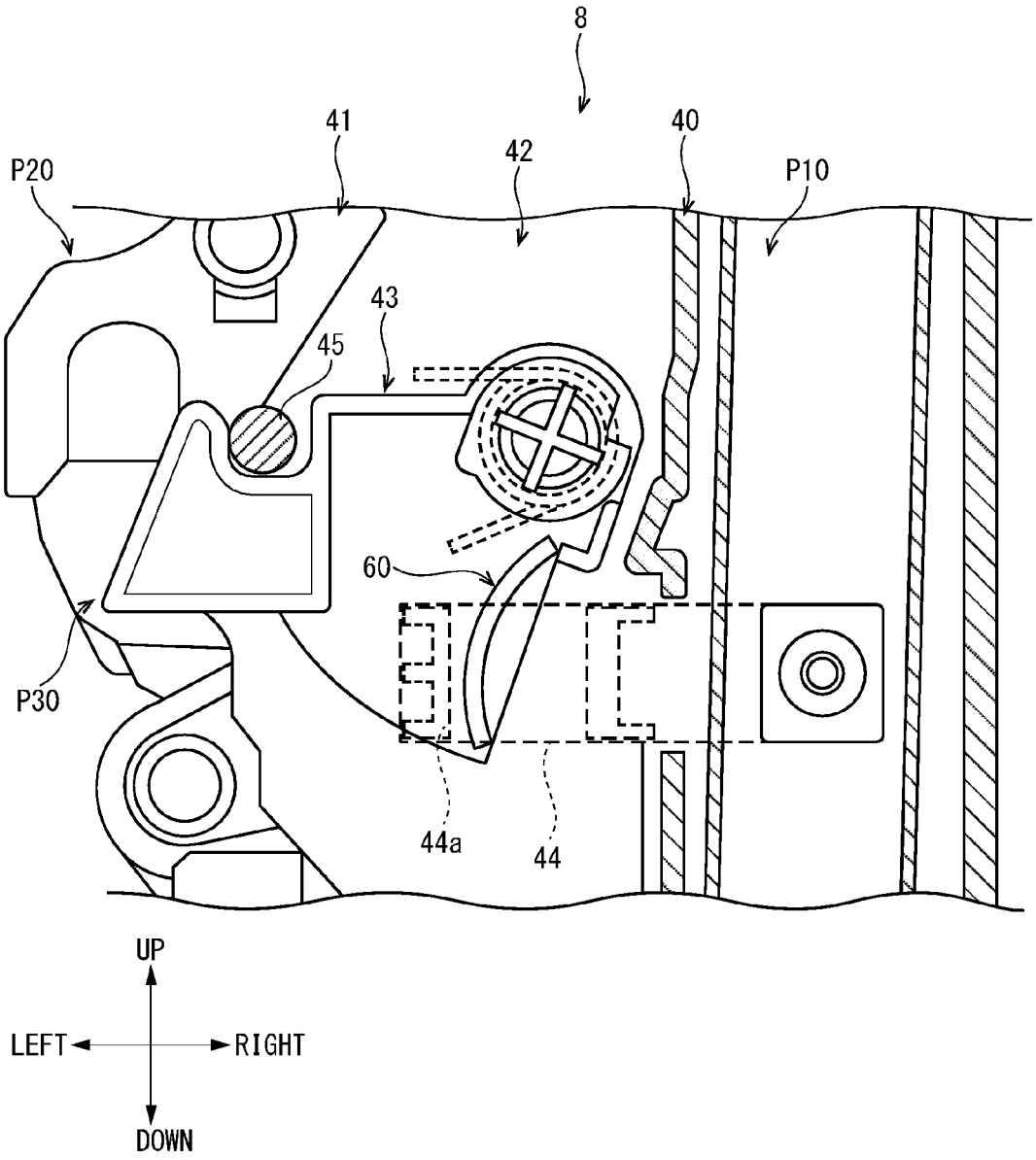
FIG. 8 is a front view illustrating the inner hook and others displaced to a lock position in the interlock mechanism of the color printer according to a modified example of one embodiment of the present disclosure.

It is noted that while the sliding-contact surface 57 is bent so as to run along the turning locus of the claw 44*a*, the present disclosure is not limited to such configuration. For instance, a sliding contact surface 60 may be curved into a circular-arc shape as shown in FIG. 8.

Still further, the case in which the present disclosure is applied to the color printer 1 as one example has been described in the present embodiment, the present disclosure is not limited to such case, and the present disclosure is applicable also to a multi-function printer, a facsimile, a monochrome printer and the like.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus, comprising:

an apparatus body;

an outer cover provided turnably between an outer closing position forming one surface of the apparatus body and an outer opening position in which the one surface of the apparatus body is set openable;

a conveyance unit disposed inside of the apparatus body more than the outer cover and provided turnably between an inner closing position in which an inside of the apparatus body is set closable and an inner opening position in which the inside of the apparatus body is set openable;

a movable roller pivotally supported by the conveyance unit and being pressed by a fixed roller pivotally supported inside of the apparatus body when the conveyance unit is displaced to the inner closing position; and an interlock mechanism interlocking an operation of opening the outer cover with an operation of opening the conveyance unit;

wherein the interlock mechanism comprises:

an inner engaging part provided in the conveyance unit and is configured to be turnable between a lock position in which the inner engaging part is locked by an engaged part provided within the apparatus body and an unlock position in which the inner engaging part is unlocked from the engaged part; and an outer engaging part fixed to the outer cover and engaging with the inner engaging part locked by the engaged part when the outer cover is displaced to the outer closing position;

wherein the outer engaging part comprises a hook-like claw at a tip extending in a direction from the outer cover to the inside of the apparatus body, wherein the inner engaging part comprises:

an engaging body provided turnably centering on an engage turning shaft;

a hook part provided continuously from the engaging body and hooked to the engaged part;

an interlock part provided projectively from the engaging body and formed so as to be in sliding-contact with the claw of the outer engaging part; and an urging member urging the engaging body toward the lock position;

wherein the hook part includes an abutment surface orthogonal to a tangential direction of a turning locus of the conveyance unit passing through a contact point of the engaged part, and the interlock part includes a sliding contact surface bent or curved so as to run along the turning locus of the claw of the outer engaging part turning in a body with the outer cover, the inner engaging part holds the conveyance unit at the inner closing position by resisting against a reaction force received by the movable roller by the hook part's locking with the engaged part;

the outer engaging part turns the inner engaging part from the lock position to the unlock position by the claw's relatively sliding with the sliding contact surface of the inner engaging part in a process of turning the outer cover from the outer closing position to the outer opening position; and the outer engaging part is disengaged relatively from the inner engaging part after turning the conveyance unit from the inner closing position to the inner opening position by the claw's relatively sliding with the sliding contact surface of the inner engaging part in a case of turning the outer cover further to the outer opening position after when the inner engaging part is displaced to the unlock position.

2. The image forming apparatus according to claim 1, wherein an outer turning shaft is formed at a lower end part of the outer cover, an inner turning shaft is formed at a lower end part of the conveyance unit, an outer cover turns centering on the outer turning shaft, wherein the conveyance unit turns centering on the inner turning shaft, and the outer turning shaft is disposed under the inner turning shaft.

3. The image forming apparatus according to claim 1, wherein an inclined surface is formed at a tip surface of the hook part, and the engaged part slides relatively on the tip surface of the hook part and turns the inner engaging part which has displaced to the lock position to the unlock position in a process of turning the conveyance unit which has been displaced at the inner opening position to the inner closing position.

* * * * *